US007342486B2

(12) United States Patent
Tsukada et al.

(10) Patent No.: US 7,342,486 B2
(45) Date of Patent: Mar. 11, 2008

(54) MONITORING DISPLAY DEVICE FOR USE ON CONSTRUCTION MACHINES

(75) Inventors: Hidenobu Tsukada, Ibaraki (JP); Hiroyuki Adachi, Obaraki (JP); Tadatoshi Shimamura, Ibaraki (JP); Kazuhiro Shibamori, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 364 days.

(21) Appl. No.: 11/000,084

(22) Filed: Dec. 1, 2004

(65) Prior Publication Data

US 2005/0151845 A1 Jul. 14, 2005

(30) Foreign Application Priority Data

Dec. 2, 2003 (JP) ..... 2003-403312

(51) Int. Cl.
*B60Q 1/00* (2006.01)

(52) U.S. Cl. ..... 340/438; 340/461; 348/148; 701/50

(58) Field of Classification Search ..... 340/438
See application file for complete search history.

(56) References Cited

U.S. PATENT DOCUMENTS

| | | | | |
|---|---|---|---|---|
| 6,115,651 | A * | 9/2000 | Cruz | 701/1 |
| 6,133,851 | A * | 10/2000 | Johnson | 340/901 |
| 2002/0003571 | A1* | 1/2002 | Schofield et al. | 348/148 |
| 2002/0175999 | A1* | 11/2002 | Mutobe et al. | 348/148 |

* cited by examiner

*Primary Examiner*—George Bugg
(74) *Attorney, Agent, or Firm*—Maier & Maier, PLLC

(57) ABSTRACT

A monitoring display system for use within a cab of an automotive vehicular construction machine to display on a monitor screen picture images of a dead angle monitor camera as a through-view in the back ground of superimposed picture images of instrumentation data indicating readings of various instruments on the machine.

10 Claims, 8 Drawing Sheets

MONITORING DISPLAY DEVICE FOR USE ON CONSTRUCTION MACHINES

This application claims the right of priority under 35 U.S.C. § 119 based on Application No. 2003-403312 filed in Japan on Dec. 2, 2003 the contents of which are incorporated herein in its entirety.

BACKGROUND OF THE INVENTION

1. Technical Field of the Invention

This invention relates to a monitoring display system to be installed in an operating room of a construction machine, for example, of a hydraulic power shovel to keep an operator informed of various operating conditions of the machine and information relating to working site or environment.

2. Prior Art

As well known in the art, hydraulic power shovels, typical of construction machines, are provided with an engine-driven hydraulic pump to supply pressure oil to hydraulic cylinders and motors or hydraulic actuators in various operating parts of the machine. The various operating parts of a machine are controlled by an operator by manipulation of control levers or other control means provided in an operating room or cab, for example, for a digging operation.

Generally, various indicators and instruments are provided in a cab of a construction machine to let an operator recognize operating conditions of the machine. For instance, indicators in the cab include an engine speedometer, fuel meter, cooling water temperature indicator, operating oil temperature indicator and hour meter. In addition, there are provided other indicators which show information needed for safe operation of the machine, for example, information whether or not a gate lock lever is in a correct position. Further, the operator is allowed to recognize the starter key position and the type of attachment which is currently attached on a front working mechanism.

Some construction machines are already furnished with a liquid crystal display monitor within a cab to indicate a diversity of information related with machine operations. By the use of a monitor display of compact construction, the operator can be constantly informed of exact operating conditions of the machine. In this connection, for the purpose of assisting an operator to operate a machine in safe conditions, there has been developed and introduced a monitor display which is arranged to display on a monitor screen picture images of a rear view monitor camera which is mounted at a rear side position of the machine to take rear views in dead angles from an operator in a cab.

In the case of a construction machine employing a rear view monitor system to display picture images of a rear view monitor camera, it becomes necessary to install a rear view monitor display in a cab along with a monitor display which displays picture images of instrumentation data, despite the likelihood of obstruction of the operator's view field in the forward direction and distraction of the operator's attention from instrumentation data. Therefore, it has been the general practice to provide in a cab a single monitor display which is switchable to display selectively either picture images of instrumentation data or picture images of a rear view monitor camera. However, this type of machine monitoring system is not desirable because an operator has to switch the monitor display from time to time during machine operations. In order to solve these problems, disclosed in Japanese Laid-Open Patent Application H11-286971 is a machine monitor display which is arranged to display picture images of minimum necessary instrumentation data and picture images of a rear view monitor camera in divided picture image display areas of a monitor screen.

In a case where two different kinds of information are displayed separately in divided image display areas of a monitor screen as mentioned above, each one of the picture image display areas is cut smaller. Namely, enlargement of a camera image display area would necessarily result in not only curtailment and lower visibility of picture images in other instrumentation data display areas but also restrictions of instrumental data to be displayed. On the contrary, enlargement of the instrumental data display area would result in curtailment of the camera image display area, that is to say, lower visibility of picture images from a camera. Thus, a monitor screen with divided image display areas has an inherent problem of low visibility of one or both picture images in two divided display areas.

Of the two kinds of picture images to be displayed on a monitor screen, a camera image is not always viewed with great concern in its entire display area. For example, picture images from a rear view monitor camera are viewed mainly when staring a machine in reverse direction or when turning an upper swing structure of the machine. In other operational scenes or in other situations, degradations in quality of camera images would not give rise to any problem in particular. Therefore, in a total camera image display area, practically other information can be overlapped in regions of less concern as long as a machine operator can get a through view of camera images behind overlapped picture images of other information.

SUMMARY OF THE INVENTION

In view of the foregoing situations, it is an object of the present invention to provide a monitoring display system for use on a construction machine, which is arranged to display two different kinds of monitoring picture images on one monitor screen in an easily recognizable way.

It is another object of the present invention to provide a monitoring display system which can display picture images from a dead angle monitor camera and picture images of instrumentation data simultaneously on one monitor screen.

In accordance with the present invention, in order to achieve the above-stated objectives, there is provided a monitoring display system for use within a cab of an automotive vehicular construction machine to display on a screen of a monitor display at least picture images of a certain number of instrumentation data, along with picture images of a dead angle monitor camera located in a dead angle position to take a view invisible or barely visible from an operator within the cab, characterized in that said monitoring display system comprises: a synthetic image generating means adapted to display picture images from said dead angle monitor camera on said monitor screen as a full-screen through-view behind superimposed picture images of said instrumentation data.

For an operator at the control of an automotive construction machine with an engine-powered hydraulic pump, it is necessary to check and monitor operating conditions of the machine constantly. In the case of a construction machine which is not required to run at a high speed, there is no need for monitoring the vehicle speed. Since a construction machine is engine-powered, an operator should constantly check the temperature of engine cooling water. In addition, it is necessary to check the fuel and operating oil temperature as well. Therefore, during operation of a construction machine, instrumentation data such as temperature of engine cooling water, residual amount of fuel and operating oil temperature should be constantly displayed on a monitor screen graphically as indicators. Preferably, these instrumentation data are graphically displayed on a monitor screen in the form of analogue style indicators.

On the other hand, picture images from a dead angle monitor camera are needed by an operator mainly for getting a rear view, that is, a view rearward of a machine. Picture images from a rear view monitor camera are also needed at the time of starting the vehicle in the reverse direction or at the time of turning an upper swing structure of the machine. Except for these operations, picture images from a rear view monitor camera are not necessarily required to be displayed on a monitor screen. Accordingly, an operator can switch a monitor display to the screen (channel) of the rear view monitor camera by way of a manual switch. However, manually switching a monitor display can be troublesome for an operator who is busy in moving the machine in the reverse direction while turning an upper swing structure.

Taking the foregoing situations into consideration, it is desirable to display picture images of a dead angle monitor camera constantly on a monitor screen and to superimpose picture images of instrumentation data on the picture images of the monitor camera. Picture images of instrumentation data suffice to be graphics of analogous indicators which are each constituted simply by a graduation line and a pointer needle. Accordingly, in displaying two kinds of picture images in an overlapped form, picture images from a dead angle monitor camera are displayed in a full-screen size on a monitor screen, and graduation lines and pointer needles of instrumentation data are superimposed thereon to show the picture images of the monitor camera as a through-view in the background. That is to say, even in those areas where indicators of instrumentation data are superimposed, picture images of the monitor camera in the background can be seen as a through-view. In this regard, the indicators of instrumentation data should be displayed in a color or shade which can be viewed in a floating state without impairing background picture images from a monitor camera.

Even if picture images from a dead angle monitor camera can be seen through superimposed picture images of instrumentation data, it is inevitable that picture images of the monitor camera are more or less degraded in superimposed areas. For example, in the case of a hydraulic power shovel, a rear view monitor camera is attached on a counterweight to check safety in rearward directions. In case the rear view monitor camera is set to have a view field in an obliquely downward in the rearward direction, a picture image of the rear view camera which is displayed on a monitor screen does not necessarily have the same importance in its entire areas in terms of safety checks. Namely, when starting the machine in the reverse direction or when turning an upper swing structure of the machine, for a safety check an operator usually takes a look at a center zone of the displayed picture image between upper and lower marginal zones. In the case of hydraulic power shovels in general, a cab or operating room and a front working mechanism are located side by side in a front side of an upper swing structure (generally a cab is built on a left front section of an upper swing structure). Accordingly, when the upper swing structure is turned to the right, views in rightward directions and in right-rearward directions are blocked by the front working mechanism and by housings and tanks which are located on rear portions of the upper swing structure, making it difficult for the operator to check safety in these directions with his or her eyes. However, on a left turn, the operator can check safety to some extent with his or her eyes in leftward and left-rearward directions.

Gathering from the foregoing, picture images in four corner portions of a monitor screen, especially picture images in upper corner portions of a monitor screen are less important in terms of safety check, and therefore are not required of high quality in sharpness. With regard to a right side portion of the monitor screen, degradations in picture quality will not give rise to a problem in particular because an operator can take a look by way of a back mirror or by turning his or her head. In short, on a left turn, if an operator noted existence of an obstacle on a monitor screen, he or she can check it more closely with naked eyes. In this manner, there are differences in importance between various monitor screen areas, so that it is possible to allot large areas to picture images of instrumentation data at less important positions on a monitor camera picture image which is displayed on a monitor screen in full-screen mode. This makes it possible to achieve the primary objective of displaying two kinds of picture images on one monitor screen in a clearly visible way.

Further, in the case of a construction machine like a hydraulic power shovel which is equipped with an excavation or other working tool and mechanism, a working spot monitor camera may be provided in addition to the above-mentioned rear view monitor camera for the purpose of enhancing working efficiency, monitoring through the working spot monitor camera a working spot and surrounding areas which are invisible from an operator in a cab of the machine. Since the machine and working mechanism are in operation, picture images of instrumentation data are superimposed on picture images of the working spot monitor camera in the same manner as in the case of the rear view monitor camera. In the case of a machine which is provided with a working spot monitor camera in addition to a rear view monitor camera, the monitor display is selectively switched to picture images from one monitor camera in relation with operations of the construction machine.

According to the present invention, synthesized picture image generating means is employed for superimposing picture images of instrumentation data on picture images of a monitor camera. In this connection, in a case where the monitor camera is a CCD camera, video signals from the monitor camera are digitally processed to generate synthesized picture images having picture images of instrumentation data overlapped on picture images of a monitor camera by the method known superimposing technique. Namely, picture images of instrumentation data are superimposed on digitally processed video signal of a picture image of a monitor camera which is displayed in full-screen mode on the monitor screen. Picture images of instrumentation data are of an analogue indicate or meter which is simply composed of a graduation line and a pointer needle. The picture images of instrumentation data can be displayed with satisfactory sharpness by varying the number of picture elements to be allotted to the respective instrumentation data picture images.

The monitor display is not always required to display synthesized picture images having picture images of instrumentation data superimposed on picture images of a monitor camera. Therefore, it is desirable to provide a switch means, more particularly, a mode selector switch which switches the monitor display between a discrete image monitoring mode and a synthesized or superimposed image monitoring mode. The mode selector switch can be a manual switch to be manually touched by an operator for switching the monitoring mode. Arrangements may be made to switch the monitor display to a suitable monitoring mode automatically in relation with operating conditions of the machine. For instance, it is possible to make arrangements in such a way as to display either instrumentation data images or camera images alone at the time of starting a machine and to display superimposed picture images once the machine has started a work.

Contents in instrumentation data picture images may be varied between the discrete monitoring mode and the superimposed monitoring mode. In the discrete monitoring mode, it is desirable to display as much information as possible. On the other hand, in the superimposed monitoring mode, it becomes necessary to limit instrumentation data display areas and to minimum necessary data to suppress to a minimum degradations in quality of monitor camera picture images.

Other information can be displayed on the monitor screen if necessary. For example, arrangements can be made to display data concerning a working schedule or procedure which are preset in a control means of the monitor display, permitting an operator to check for actual progress of a work against preset data. Further, arrangements also can be made to display messages which are received by wireless communication with a machine management center. Preferably, messages of this sort are displayed before starting a machine, after a work or when the machine is off. Furthermore, from the standpoint of preventing accidents, it is desirable to display a warning message as soon as an abnormal state is detected in operating conditions of a machine. Upon detection of an abnormal state, a warning message is displayed on the monitor screen alone or in place of picture images of instrumentation data which are superimposed on picture images of a monitor camera.

The above and other objects, features and advantages of the present invention will become apparent from the following particular description of the invention, taken in conjunction with the accompanying drawings which show by way of example some preferred embodiments of the invention. Needless to say, the present invention should not construed as being limited to particular forms shown in the drawings.

PREFERRED EMBODIMENTS OF THE INVENTION

Hereafter, the present invention is described more particularly by way of its preferred embodiment. In the following description of preferred embodiments, the present invention is applied by way of example as a monitoring display device of a hydraulic power shovel. However, needless to say, the present invention can be similarly applied to other construction machines.

Figure 1:
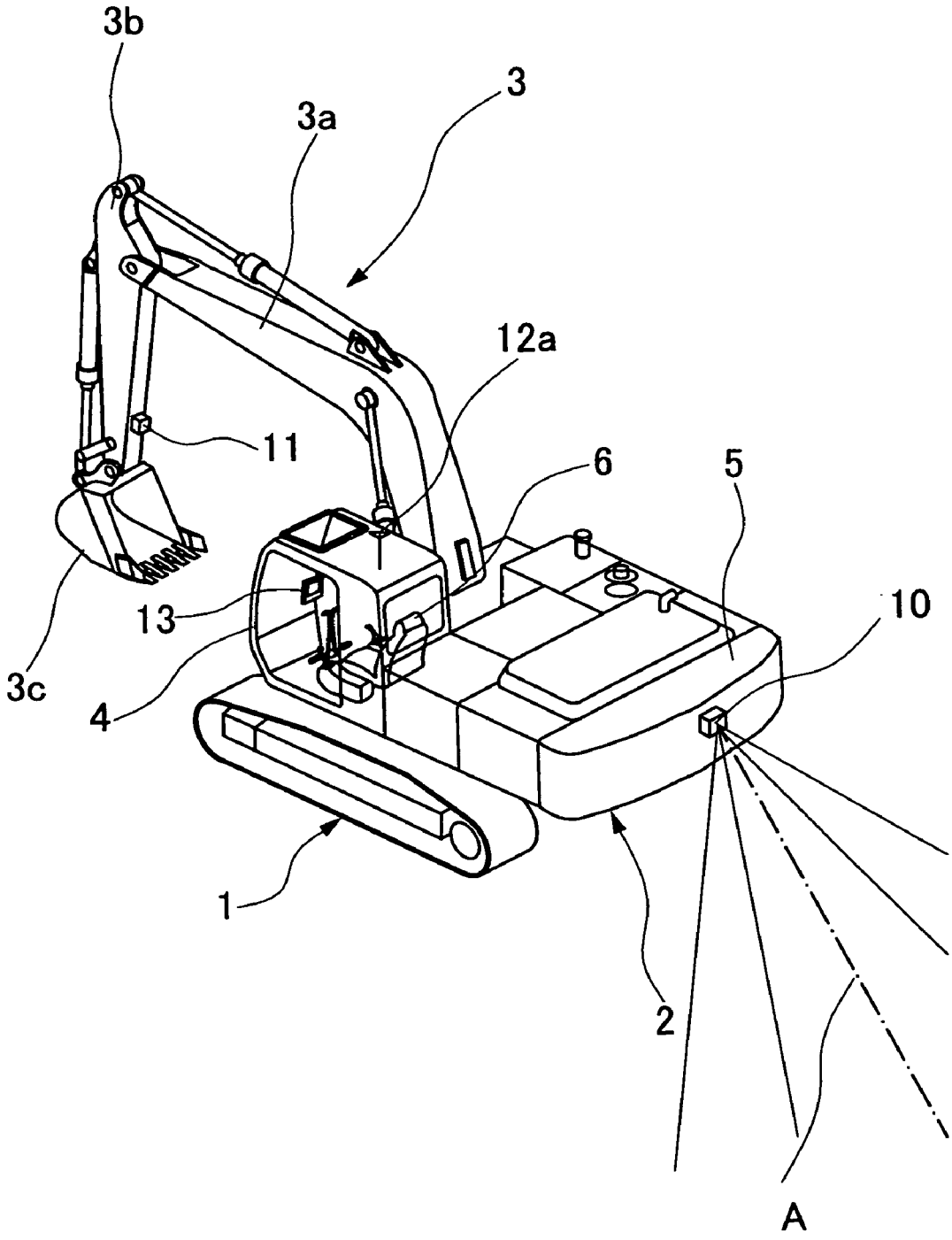
FIG. 1 is a schematic view of a hydraulic power shovel, a typical example of construction machines to which the present invention is applicable.

Referring first to FIG. 1, there is shown general construction of a hydraulic power shovel. In FIG. 1, indicated at 1 is a crawler type automotive base carrier, at 2 an upper swing structure, and at 3 a front working mechanism which is provided on the upper swing structure 2 and equipped with a digger shovel for ground excavating operations. Further provided on the upper swing structure 2 is an operating room (a cab) 4 to be occupied by an operator. Various control levers, pedals and switches are provided in the operating room 4 for controlling operations of the vehicular base carrier 1, swing motions of the upper swing structure 2 and operations of boom 3*a*, arm 3*b* and bucket 3*c* of the front working mechanism 3.

Being generally built in the manner as described above, the hydraulic power shovel is of a hydraulic drive type, driving hydraulic actuators like hydraulic motor and hydraulic cylinders by pressure oil which is supplied from an engine-driven hydraulic pump. Therefore, the hydraulic power shovel is provided with various sensors to check for its operating conditions, including sensors for detecting operating conditions of the engine, sensors for detecting operating conditions in various parts of the hydraulic drive system, and sensors for detecting conditions at different operating pars of the front working mechanism. Data of operating conditions acquired from various sensors include those data which need to be recognized by an operator and those data which do not need recognition by an operator. Further, the data of operating conditions which need to be recognized by an operator contain data which need urgent and unmistakable recognition by an operator. Namely, data which need recognition by an operator of a hydraulic power shovel include data on general operating conditions of the vehicle and data of abnormality such as data of abnormal operating conditions which would lead to a serious trouble of the hydraulic power shovel.

Figure 2:
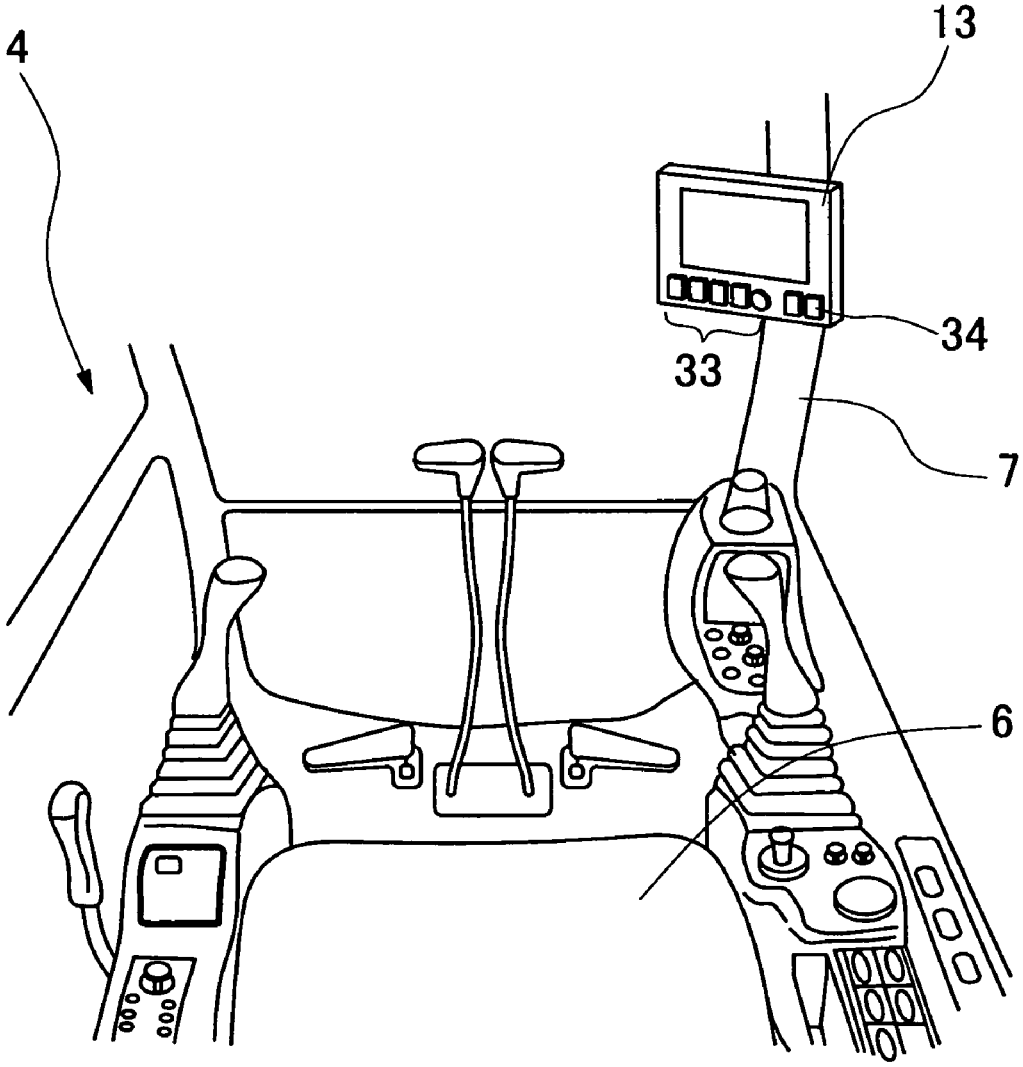
FIG. 2 is a schematic view of interior layout of an operating room of the hydraulic power shovel of FIG. 1.

For the purpose of ensuring safe and efficient operations, some hydraulic power shovels are provided with a rear view monitor camera at the back of the upper swing structure, as shown in FIG. 2, to reduce dead angles for the operator who is seated in the cab. In that figure, indicated at 10 is a rear view monitor camera which is set on the back side of a counterweight at the rear end of the upper swing structure 2 to take a rear view which is in a dead angle from the operator in the cab. Indicated at 11 is another monitor camera which is mounted in the vicinity of the fore end of the arm 3*b* of the front working mechanism 3 to take an inside view of a working spot, for example, a deeply dug hole which is also in a dead angle from the operator in the cab 4. Namely, picture images from the monitor camera 11 are relied on particularly at the time of confirming conditions inside a deeply dug portion which cannot be seen by the operator in the cab 4. Besides, the monitor camera 11 can assist the operator by providing dead angle views during an operation at a height. In this regard, a hydraulic power shovel is not necessarily required to be provided with both of the monitor cameras 10 and 11. A monitor camera should be provided at a suitable position depending upon the nature of work and conditions of a working site. Of the two monitoring cameras 10 and 11, the rear view monitor camera 10 should preferably be provided from the standpoint of safety operations. Another monitor camera may be located in other dead angle position to get assisting views for the operator.

Further, a wireless communication means is provided on the hydraulic power shovel to permit communications with a machine management center or other related facilities in a remote place. Wireless communication means makes it possible to manage various construction machines including hydraulic power shovels under a centralized management system, for example, in acknowledging current conditions at various working sites, managing distributions of consumable stores and/or managing working schedules of individual construction machines. For these purposes, the hydraulic power shovel is provided with at least a communication device 12 (see FIG. 8) and an antenna 12*a*. The communication device 12 on the side of the hydraulic power shovel may be either a reception only type or a bidirectional type.

As shown in FIG. 2, a monitor display 13 in the form of an LCD (liquid-crystal display) is provided in the cab 4 to display various information and operational data to be recognized by an operator at the control of the machine. Accordingly, the monitor display 13 is located in such a position as to be easily viewed by the operator while manipulating various control means of the machine. In this regard, however, it is necessary for the monitor display 13 not to obstruct a forward view field of the operator. For this purpose, the monitor display 13 should preferably be of a relatively small screen size and, for example, located on a pillar 7 in an obliquely forward direction from the operator's seat.

In indicating various information or data as mentioned hereinbefore, the monitor display 13 is adapted to display such information and data in groups and in a plural number of screen modes which can be selected through a switch means. Picture images are displayed on the screen of the monitor display 13, for example, in five screen modes as shown in FIGS. 3 to 7. Of these five screen modes, FIGS. 3 to 6 show screens in an independent or discrete monitoring mode, while FIG. 7 shows a screen of a superimposed image monitoring mode. Thus, necessary information and data are displayed on the monitor display 13 either on one of discrete monitor screens in the discrete monitoring mode or on a superimposed picture image in the superimposed monitoring mode as shown in FIG. 7.

Figure 3:
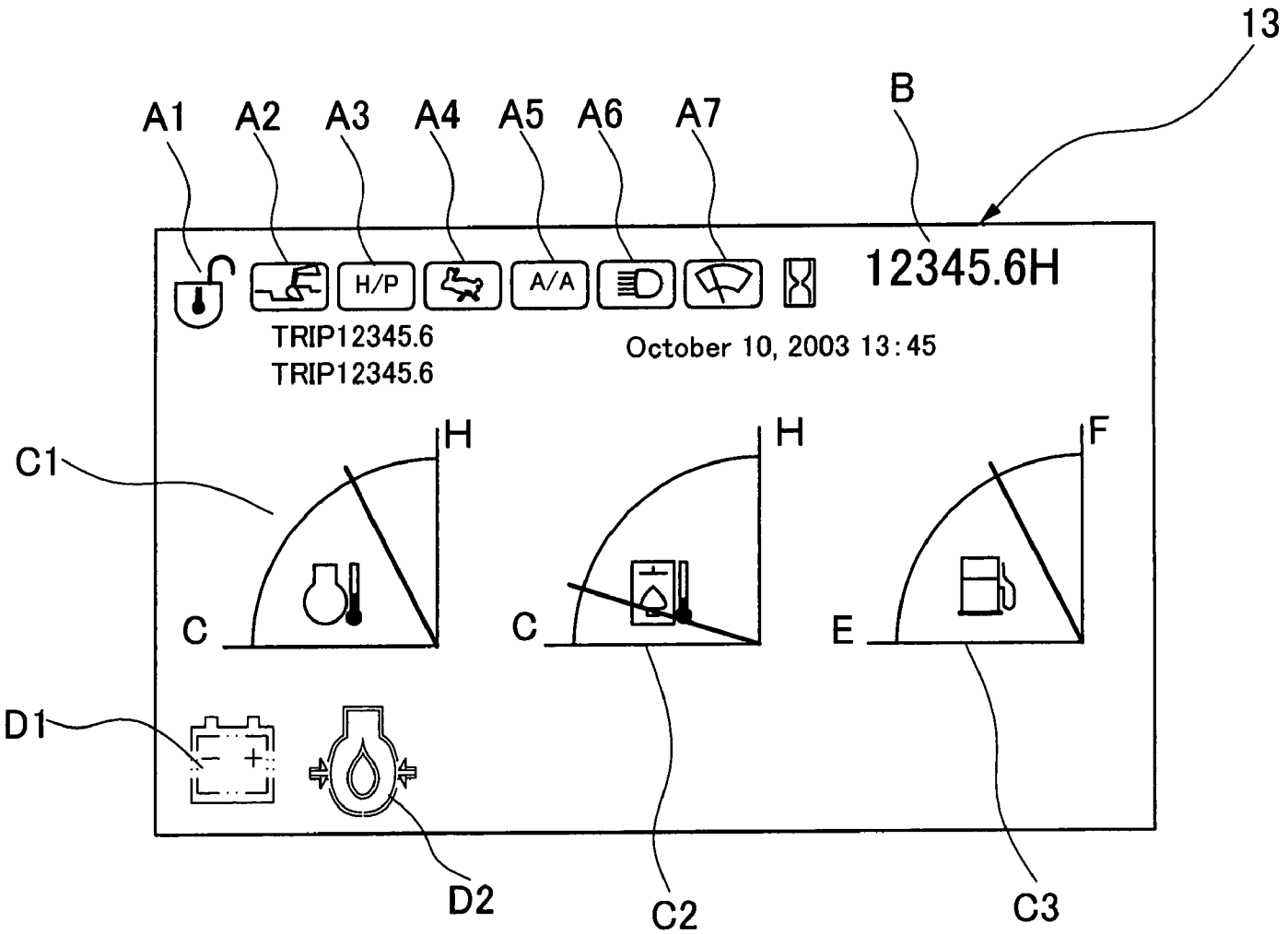
FIG. 3 is a schematic illustration showing an example of machine condition monitoring screen mode a monitor display.

In the first place, shown in FIG. 3 is one screen displaying current operating conditions of the vehicle by way of symbolic graphical images. More particularly, this monitor screen for current operating conditions has a series of icons A1 to A7 appearing from an upper left corner, namely, an icon A1 indicating whether or not an anti-theft security mechanism is on, an icon A2 indicating whether or not a bucket 3*c* or other tool is attached to the fore end of the arm 3*b* of the front working mechanism 3, an icon A3 indicating operating load conditions, an icon A4 indicating a vehicle speed, an icon A5 indicating whether or not the vehicle is auto-idling, an icon A6 indicating whether or not an illumination lamp is on, and an icon A7 indicating whether or not a wiper is on. Further, displayed in a central broad display area under the row of icons A1 to A7 are graphic indicators and characteristic figures or symbols of instrumentation data, including from left to right, an engine cooling water temperature indicator C1, an operating oil temperature indicator C2, and fuel meter C3. Displayed in a lower left corner are graphics for battery indicator D1 and engine oil pressure indicator D2, which appear in different density or in different color when the battery level and the engine oil pressure drop down from a predetermined normal level.

The current operating conditions monitor screen is not necessarily required to display all of the above-mentioned information or data, and may be arranged to include other information. In short, the screen should display current vehicle conditions to be recognized by the operator. However, irrespective of the display style, at least the engine cooling water temperature indicator C1, operating oil temperature indicator C2 and fuel meter C3 should always be included.

Figure 4:
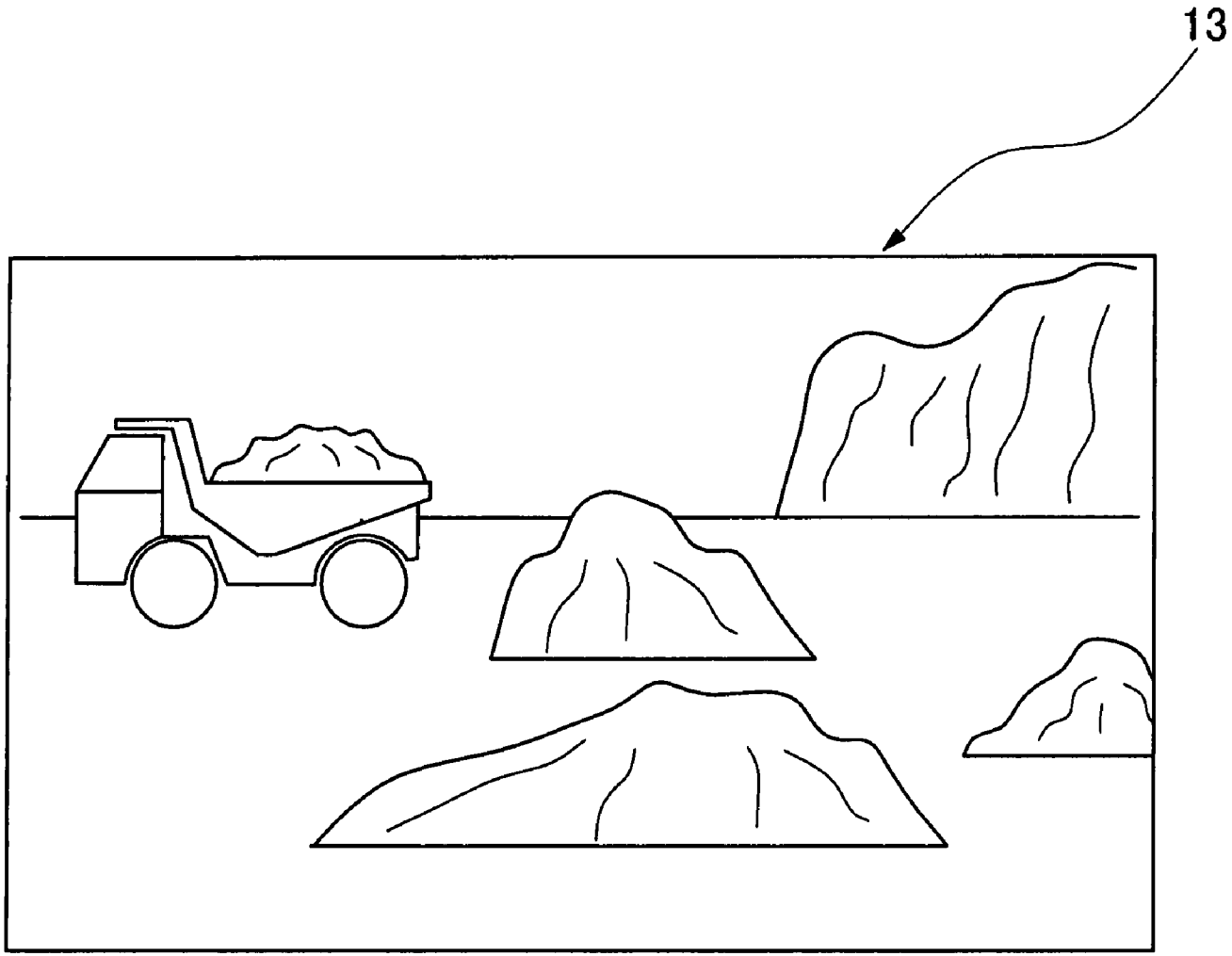
FIG. 4 is a schematic illustration showing an example of rear view monitoring screen mode.

Shown in FIG. 4 is an example of a picture image of a dead angle view monitor camera, displayed on the monitor screen to assist the operator. More specifically, in the particular example shown, a scenery picture image captured by a rear view monitor camera 10 is displayed on the monitor screen in a full-screen mode to insure safe operations. Likewise, by a switching action, a picture image captured by the working spot monitor camera 11 for confirmation of a working area is also displayed on the monitor screen in a full-screen mode.

Figure 5:
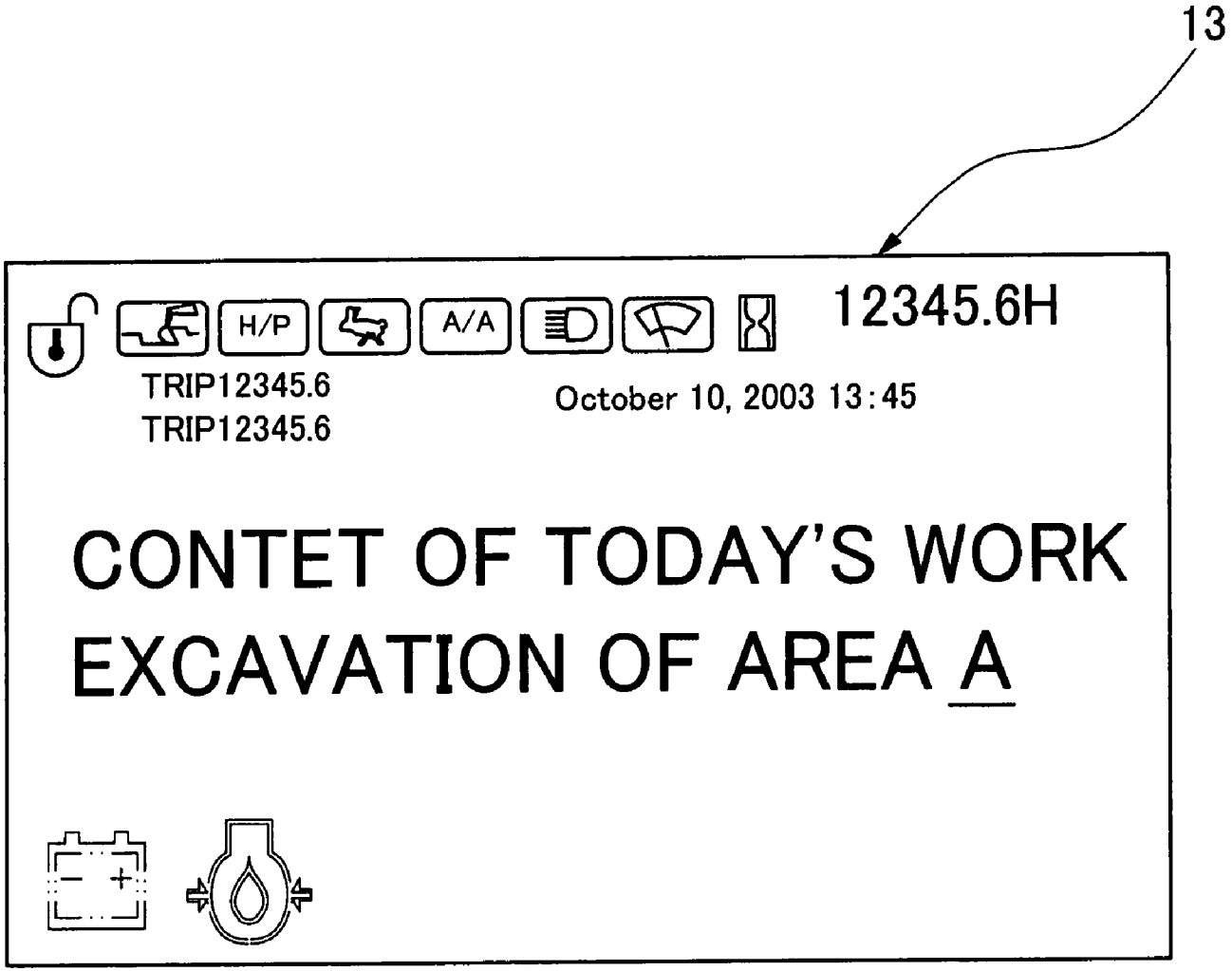
FIG. 5 is a schematic illustration showing an example of communication message display screen mode.

Further, shown in FIG. 5 is an example of a received communication data monitor screen. Basically, the received communication data are messages and commands which are received from a management center or related facilities. Messages can be of any kind. For example, messages may relate to particulars of working schedules, working sites or working machines, and shown in place of the instrumentation data graphics display areas C1 to C3 of FIG. 3. In a case where bidirectional communication is feasible, contents of a transmitted message from an operator may be shown in these display areas C1 to C3. When a message is received from a machine management center, arrangements may be made to blink a reception mark at a suitable position on the monitor screen, for example, at a lower right corner of the screen in FIG. 3 or to open a dialogue window to draw attention of the operator.

Figure 6:
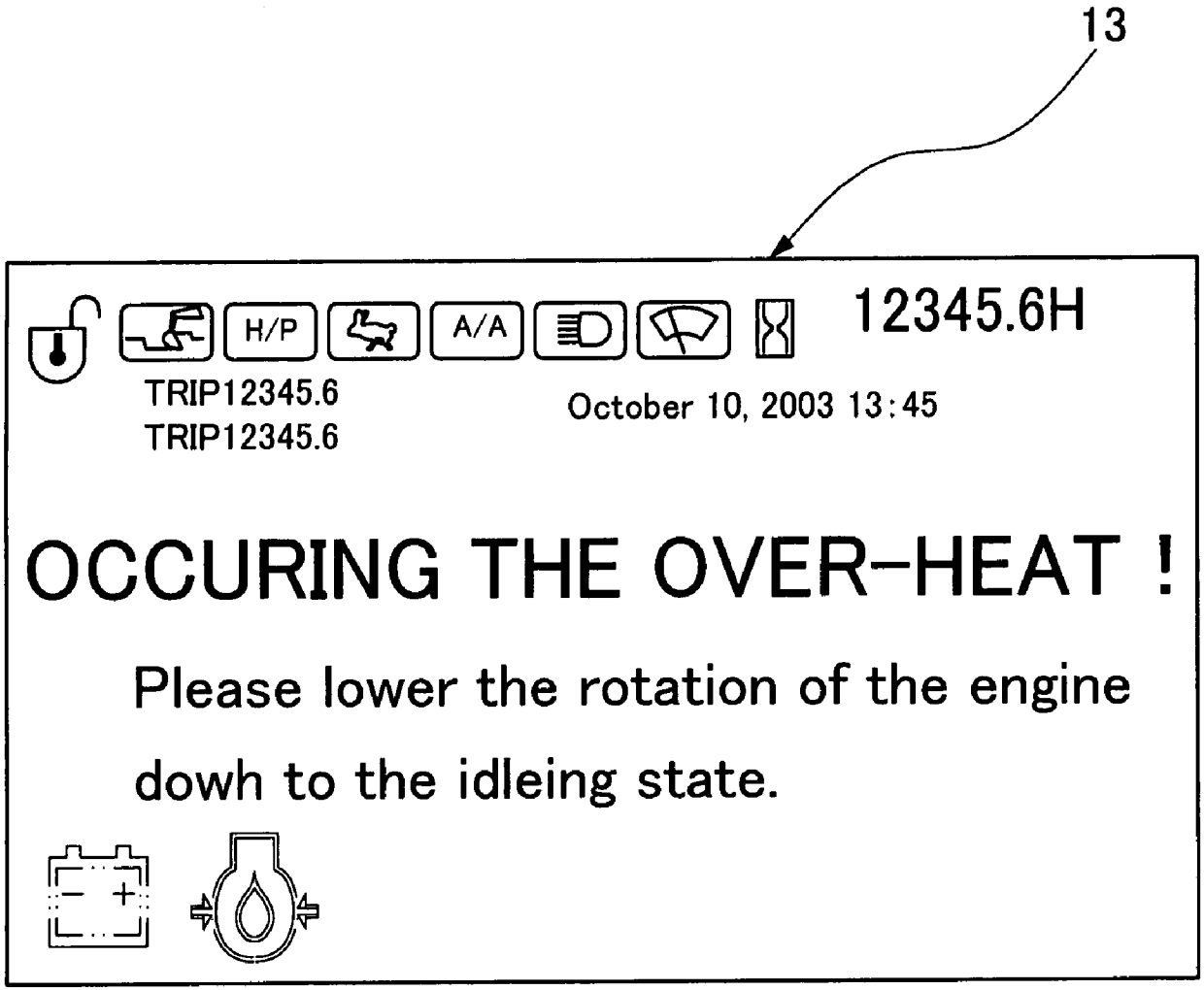
FIG. 6 is a schematic illustration showing an example of alert message display screen mode.
Figure 7:
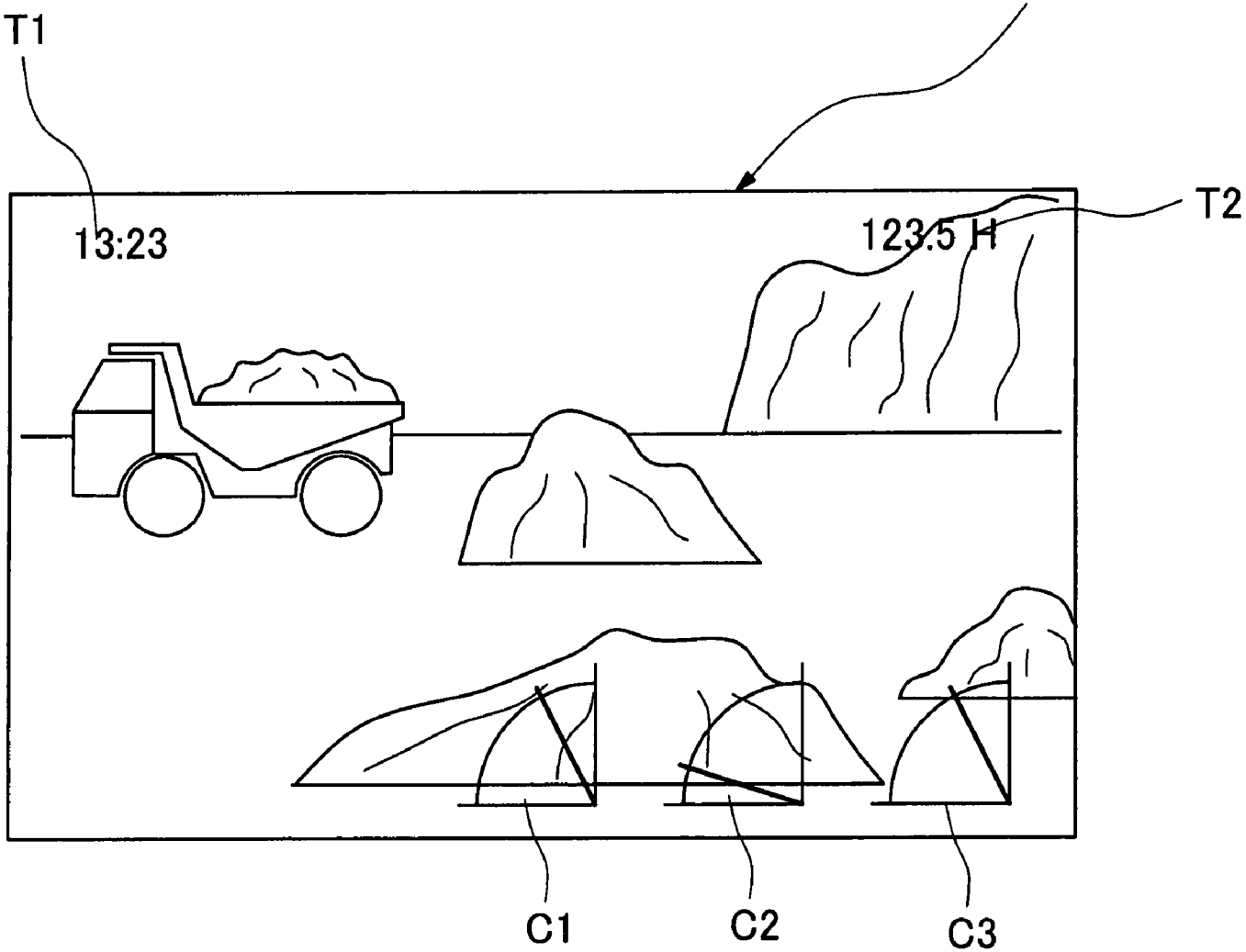
FIG. 7 is a schematic illustration showing the monitor display in a synthesized or superimposed image monitoring mode, showing a picture image of a rear view monitor camera as a through-view in the background of picture images of instrumentation data.

Shown in FIG. 6 is an example of an abnormal conditions monitor screen. Abnormal conditions include, for example, occurrence of such an abnormal state which will lead to a serious problem or accident if operation is continued, i.e., abnormal states such as a drop of engine oil pressure below a predetermined value, a rise of engine cooling water temperature above a predetermined value, an abnormal rise of operating oil temperature and clogging of a filter which is provided on the intake side of the engine. These abnormal states can be recognized through information on vehicle operating conditions. However, in view of the gravity of the matter, an abnormal state should be recognized by an operator as soon as possible and in an unmistakable way, by indicating an alert message about the nature of the abnormal state in a center area of the monitor screen 13, namely, in the instrumentation data graphics display areas C1 to C3 in FIG. 3 by the use of large letters in an eye-catching color. For the sake of safety, it is desirable to give off an alert sound for a time period of several seconds to several tens second n addition to the display of an alert message on the monitor screen.

Further, shown in FIG. 7 is a synthesized or superimposed image monitor screen which is produced by superimposing images of two different kinds of information. The background of this synthesized screen is a picture image from the rear view monitor camera shown in FIG. 4, and superimposed on this picture image of the rear view camera are graphic images of the instrumentation, i.e., graphics of engine cooling water temperature indicator C1, operating oil temperature indicator C2 and fuel meter C3 in the screen mode of FIG. 3 displaying current vehicle conditions. In this case, the picture images of instrumentation data including the engine cooling oil temperature indicator C1, operating oil temperature indicator C2 and fuel meter C3 are arranged to show instrumentation data in the fashion of an analogue indicator or meter, which is simply composed of a graduation line or mark and a pointer needle. In the discrete monitoring screen of FIG. 3, each one of picture images of instrumentation data includes a symbolic sign or characters indicative of engine cooling oil temperature, operating oil temperature or fuel meter, in addition to a graduation line and a pointer needle. In producing a synthesized image monitor screen by superimposition of instrumentation data, the symbolic signs are omitted to let the operator see through clearly almost the entire areas of the picture image of the rear view camera except the graduation lines and pointer needles. When picture images of instrumentation data graphic in the discreet monitor screen of vehicle conditions are superimposed in this manner, more or less the quality of the picture image of the rear view camera is degraded in the superimposed areas.

In this connection, the rear view monitor camera 10, which is employed in the present embodiment for monitoring the rear side of the machine, is located at an upper position on and at an approximately intermediate position across the width of the counterweight 5. Besides, the optical axis A of the objective lens is inclined in a downward direction. Thus, the rear view monitor camera 10 has a rearward view field range as indicated in FIG. 1. In this instance, the operator on the hydraulic power shovel needs rear view monitoring at the time of starting the vehicle in reverse direction or at the time of turning the upper swing structure to confirm if there is any person, machine or equipment or architectural body or other obstacle in a range of movements of the machine. If there is possibility of interference with one of these, the operator can stop the vehicle as a safety measure. On such an occasion, the picture image from the rear view camera 10 does not necessarily have the same importance across its entire picture areas.

That is to say, in the picture image of the rear view monitor camera on the monitor display 13, upper areas of the picture image are less important because an obstacle at a higher position than the top side of the counterweight 5 would not incur any danger in particular even when turning the upper swing structure 2 around. Further, as clear from FIG. 1, an operator within the cab 4 which is located on a left side section of the upper swing structure 2 can get substantially no views in rearward and obliquely rearward directions on the right side of the machine, although he or she can get views in rearward or obliquely rearward directions to a certain extent on the left side of the machine. Accordingly, at the time of checking rearward directions, the operator relies on a left half portion of the rear view picture image on the monitor display 13. More specifically, the monitoring image is required to be as sharp as possible in a vertically intermediate zone of the screen, and high quality image is not required in an upper zone running in a certain width along the upper side of the screen and in lower left areas of the screen as well because degradations in image quality in these portions have no adverse effects on rear view monitoring.

Taking the foregoing into account, in the picture image of the rear view monitor camera on the monitor display 13 is in the superimposed monitoring mode as shown in FIG. 7, the engine cooling water temperature indicator C1, operating oil temperature indicator C2 and fuel meter C3, each composed of a graduation line and a pointer needle, are displayed in lower left areas of the screen, and the picture image from the rear view monitor camera is displayed in a full-screen size in the background as a through-view behind superimposed graduation lines and pointer needles of instrumentation data. Further, as seen in FIG. 7, clock time T1 and operating time T2 are indicated in upper right and left corners of the screen. The operating time T2 is same as the operating time which is indicated at B on the screen of operating condition display mode shown in FIG. 3.

Figure 8:
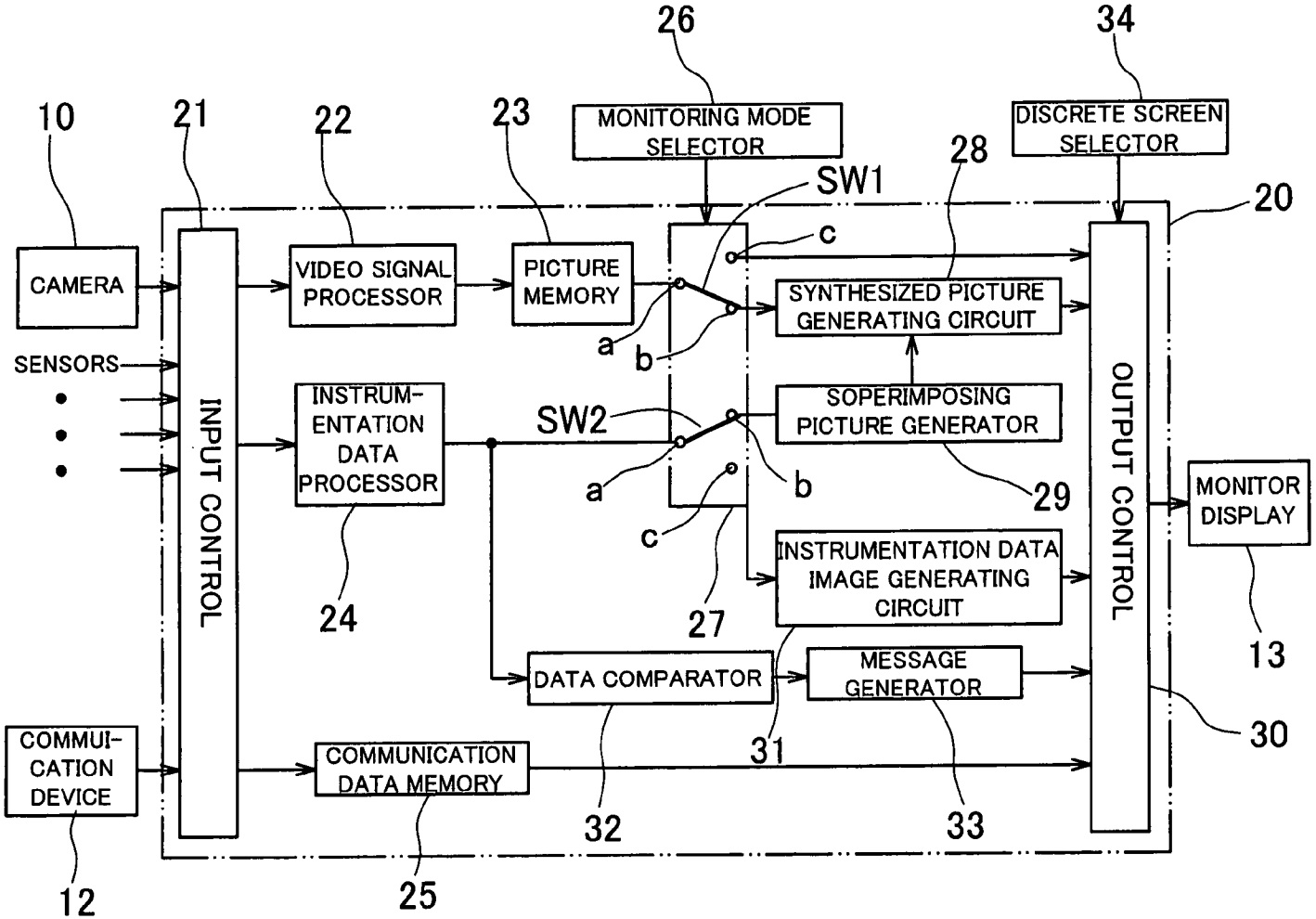
FIG. 8 is a block diagram of a display controller.

Now, turning to FIG. 8, there is shown a display controller 20 which controls various screen modes of the monitor display 13. The display controller 20 is provided with an input control 21 to receive signals from sensors watching various parts of the machine as well as video signals from the external rear view monitor camera 10 (or the working spot monitor camera 11) and signals received by the communication device 12.

Video signals from the rear view monitor camera 10, received through the input control 21, are fed to a video signal processor 22 to generate video signals to be displayed on the monitor display 13. Generated video signals are stored in a picture memory 23. Signals from various instruments of the machine as well as signals from various sensors watchful of various operating parts of the front working mechanism 3 are incessantly received at the input control 20. These input signals are fed to instrumentation data processing circuit 20 to generate instrumentation data indicative of current operating conditions of the machine. Further, message data received by the communication device, for example, as a result of communication with a machine management center are stored in a communication data memory 25.

The monitor display controller 20 is further provided with a monitoring mode selector means 26 to put the monitoring display either in a discrete monitoring mode which displays either picture images from the rear view camera 10 or picture images of machine conditions on a discrete monitor screen independently of each other, and a synthesized or superimposed image monitoring mode which displays picture images of the rear view camera and picture images of machine conditions in a superimposed state. For this purpose, switches SW1 and SW2 are provided on the output side of the picture memory 23 and the instrumentation data signal processor 24, respectively. When the synthesized image monitoring mode is selected, contact points a of the switches SW1 and SW2 are closed on the side of contact points b. On the other hand, when the discrete monitoring mode is selected, the contact points a are closed on the side of contact points c. One contact point b on the side of the picture memory 23 is connected to a synthesized image generating circuit 28 thereby to generate a synthesized picture image by superimposing picture images of instrumentation data, which are generated by a superimpose picture image generating circuit 29, on picture images of the rear view monitor camera which are received from the picture memory 23. In this instance, at the superimpose picture image generating circuit 29, graphical picture images for the engine cooling oil temperature indicator C1, operating oil temperature indicator C2, fuel meter C3, clock time T1 and operating time T2 are generated by way of graduation lines and pointer needles or by way of numerical figures in the respective places on the screen of the monitor display 13 as indicated in FIG. 7. At the synthesized picture image generating circuit 28, the graphical picture images of the instrumentation data from the superimpose picture image generating circuit 29 are superimposed on the picture image of the rear view monitor camera from the picture memory 23 to synthesize a picture image which shows the picture image of the rear view monitor camera in the background as a through-view behind picture images of instrumentation data, and the synthesized picture image is output to an output control 30.

Two different forms of picture images are generated on the basis of output signals of the instrumentation data processor 24. At the above-mentioned superimpose picture image generating circuit 29, a limited number of instrumentation data are superimposed on picture images of a monitor camera in a limited form or size. In addition to the superimpose picture image generating circuit 29, an instrumentation data picture image generating circuit 31 is connected to the contact point b of the switch SW2 in order to generate and display picture images of instrumentation data independently. In this instance, picture images of instrumentation data are output from the instrumentation data picture image generating circuit 31 to the output control 30 to show various instrumentation data on the screen of the monitoring display 13 independently as a machine condition monitor screen shown in FIG. 3. When the contact points a and c of the switch SW1 are closed, picture images from a monitor camera are output to the output control 30 from the picture memory 23.

At a point anterior of the display mode selector 27, a data comparator 32 is connected to the output side of the instrumentation data signal processing circuit 24. The data comparator 32 contains numerical data as reference data in detecting abnormalities. Therefore, output signals from the instrumentation data processor 24 are compared with reference data in the data comparator 32 to check for occurrence of an abnormal state in machine conditions. That is to say, the data comparator 32 functions as an abnormality detection means. As soon as an abnormal state is detected by the data comparator 43, a corresponding alert message is generated by a message generator 33 and output to the output control 30 to display the alert message on the monitor screen. Further, communication data, which have been received by the communication means 12 are also sent to the output control 30 from the communication data memory 25.

When the synthesized image monitoring mode is selected by way of the monitoring mode selector 7, a synthesized picture image (as shown in FIG. 7) is output to the monitoring display 13 from the output control 30, showing picture images of instrumentation data in a superimposed state on a picture image of a monitor camera like the rear view camera. On the other hand, when the discrete monitoring mode is selected by way of the monitoring mode selector 7, video signals of a monitor camera from the picture memory 23, signals of operating conditions from the instrumentation data image generating circuit 31 or received communication data from the communication data memory 24 are output to the monitoring display 13 from the output control 30.

However, a picture image of abnormal data is not output to the monitor display 13 as long as the machine is in normal conditions. In the event of occurrence of an abnormal state, it is necessary to let the operator recognize the abnormal state promptly in an unmistakable way. Therefore, upon detection of an abnormal state, the monitoring display 13 is instantly and automatically switched by the display controller to show a warning picture image to draw operator's attention to a detected abnormal state. For example, in the case of engine cooling water temperature, a value of an actually measured cooling water temperature from the instrumentation data processor 24 is compared at the data comparator 32 with a reference value, that is, a criterion for judging whether or not the engine cooling water has exceeded a maximum allowable value. When it is found that the actually measure value of the engine cooling water temperature has exceeded the reference value, a warning message is output from the message generator 33 to the monitoring display 13 through the output control 30 to put the warning message on the screen of the monitoring display, for example, in the manner as shown in FIG. 6. Namely, triggered by an output of the data comparator 32, the monitoring display 13 is immediately switched to the abnormality warning screen, for example, from a camera view monitoring mode.

In this instance, when the discrete monitoring mode is selected by way of the display mode selector means 26, picture images of a monitor camera stored in the picture memory 23, picture images of machine operating conditions from the instrumentation data image generating circuit 31 or picture images of received communication data from the communication data memory are displayed on the screen according to a signal from a discrete monitor screen selector 34. Accordingly, the monitor display 13 can be switched to a desired discrete monitor screen mode by way of the discrete screen selector 34. In this regard, however, it is desirable to make arrangements in such a way that a predetermined discrete monitor screen is selected and displayed by top priority upon switching the monitor display 13 to the discrete monitoring mode.

Generally, priority is given to the discrete monitor screen of current operating conditions of the machine, and the monitor display 13 is switched to other discrete monitor screens by way of the discrete screen selector means 34. Besides, it is also possible to make arrangements in such a way as to give priority to certain kinds of picture images in selecting monitoring picture images in relation with operating conditions of a hydraulic power shovel or the like. Namely, arrangements can be made to display vehicle operating conditions when the hydraulic power shovel is in operation and to give priority to picture images of a monitor camera when the machine is in an idling state. Moreover, while the vehicle conditions monitor screen is on display by selection of the discrete monitoring mode, the monitoring display 13 can be automatically switched to picture images of the rear view monitor camera as soon as an operator handles a control lever to start the vehicle in reverse direction or to turn the upper swing structure 2.

Any way, the monitoring mode selector means 27 and the discrete screen selector means 34 can be constituted by switches, which are located either on a fascia board of the monitor display 13 or in positions which are easily accessible by the operator like control levers. In most cases, during an excavating or digging operation, an operator who is seated on the operator's seat 6 within the cab 4 grips in both hands control levers of a working mechanism which are provided on or in the vicinity of arm rests of the operator's seat 6. Accordingly, switches of the monitoring mode selector means 27 and the discrete screen selector means 34 may be provided on such a control lever or levers to let the operator change the monitoring mode or channel by a quick and smooth action.

Being arranged in the manner as described above, the monitor display 13 of the monitoring display system can display, in an overlapped manner, two different kinds of information which are greatly important to an operator in operating a construction machine like a hydraulic power shovel, permitting the operator at the control of the hydraulic power shovel to recognize current operating conditions of the machine from displayed instrumentation data and at the same time to check for safe conditions in surrounding areas by way of picture images of a rear view monitor camera or other dead angle monitor cameras. Thus, the monitoring display system according to the present invention can assist an operator greatly in operating a hydraulic power shovel or a similar construction machine in a smooth and stabilized manner, and in confirming safety at the time of starting the vehicle in reverse direction and at the time of turning an upper swing structure of the machine.

Namely, of readings of various instruments, an operator at the control of a hydraulic shovel only needs to pay attention to the instrumentation data which are selectively shown on the monitor screen 13 as important data, that is, to engine cooling water temperature indicator C1, the operating oil temperature indicator C2 and the fuel meter C3. Since these instrumentation data are displayed in large sizes, an operator can accurately and unmistakably grip the operating conditions of the machine. At the time of starting the vehicle in reverse direction or at the time of turning an upper swing structure 2, an operator can safely operate the machine, looking at picture images from a dead angle monitor camera on the monitor display 13 as a full-screen through-view behind superimposed instrumentation data. Although the quality of picture images of a monitor camera is degraded to some extent in the superimposed areas, it will give rise to no problem as long as the operator can check for existence of an obstacle in those areas. In case there is an obstacle, the operator can get details of the obstacle for safety purposes by looking back to get a direct view of the obstacle or by observing the obstacle on a back mirror.

It is to be understood that the instrumentation data display screen mode shown in FIG. 7 is simply an example of presentation. Of course, the positions of the instrumentation data on the monitor display 13 can be changed. For example, instrumentation data may be displayed in an upper right corner portion in place of the operating time T2, if desired, shifting the positions of the clock time T1 and the operating time T2 to a lower portion of the monitor screen. Otherwise, the instrumentation data may be located separately in dispersed position if desired. For example, the instrumentation data may be displayed separately in three corner portions of the display screen, while displaying the clock time T1 and the operating time T2 together in the remaining corner portion.

As described in detail hereinbefore, according to the present invention, operating conditions and other necessary information are displayed on the screen of one monitoring display in a clearly visible way for an operator at the control of a construction machine like a hydraulic power shovel.

What is claimed is:

1. A monitoring display system for use within a cab of an automotive vehicular construction machine to display on a screen of a monitor display at least picture images of a certain number of instrumentation data, along with picture images of a dead angle monitor camera located in a dead angle position to take a view invisible or barely visible from an operator within said cab, characterized in that said monitoring display system comprises:

a synthetic image generating means adapted to allocate picture images from said dead angle monitor camera to a dominant display area including a center area on said monitor screen and to superimpose picture images of said instrumentation data in marginal or peripheral display areas of said monitor screen.

2. A monitoring display system as defined in claim 1, wherein said picture images of instrumentation data includes picture images of an engine cooling water temperature indicator, an operating oil temperature indicator and a fuel meter, and said dead angle monitor camera is a rear view monitor camera.

3. A monitoring display system as defined in claim 2, wherein said picture images of instrumentation data are of an analogue style indicator or meter.

4. A monitoring display system as defined in claim 2, wherein, in addition to said rear view monitor camera, said construction machine is provided with a working spot monitor camera for monitoring a working means and surrounding areas, said monitor display being adapted to display selectively either picture images from said rear view monitor camera or picture images from said working spot monitor camera as a through-view behind superimposed picture images of instrumentation data.

5. A monitoring display system as defined in claim 1, wherein said synthesized image generating means is adapted to control superimposition of said picture images of instrumentation data on picture images from a monitor camera.

6. A monitoring display system as defined in claim 1, wherein said monitoring display device is switchable between a superimposed image monitoring mode showing picture images of instrumentation data superimposed on picture images of a dead angle view monitor camera, and a discrete monitoring mode for monitoring picture images of instrumentation data or picture images of a monitor camera on said monitor screen separately and independently of each other.

7. A monitoring display system as defined in claim 6, wherein said monitoring display device is provided with a manual switch means for switching operation between said superimposed monitoring mode and discrete monitoring mode.

8. A monitoring display system as defined in claim 6, wherein said monitoring display device is adapted to switch operation automatically from said superimposed image monitoring mode to said discrete monitoring mode or vice versa depending upon operating conditions of said construction machine.

9. A monitoring display system as defined in claim 1, wherein said monitoring display device is adapted to display a different group of instrumentation data in said superimposed monitoring mode, from a group displayed in said discrete monitoring mode.

10. A monitoring display system as defined in claim 1, wherein, upon detection of abnormality in operating conditions of said construction machine, said monitoring display device is adapted to display a warning message on said monitor screen in place of picture images of instrumentation data.

* * * * *